US007168985B1

(12) United States Patent
Zhang et al.

(10) Patent No.: US 7,168,985 B1
(45) Date of Patent: Jan. 30, 2007

(54) ELECTRICAL CONNECTOR ASSEMBLY HAVING AN IMPROVED INNER SHIELD

(75) Inventors: Dao-Kuan Zhang, Kunshan (CN); Qing Wan, Kunshan (CN); Li-Chun Wu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/323,771

(22) Filed: Dec. 30, 2005

(30) Foreign Application Priority Data

Aug. 20, 2005 (CN) ..... 2005 2 0074826

(51) Int. Cl.
*H01R 13/648* (2006.01)

(52) U.S. Cl. ..... 439/607; 439/541.5

(58) Field of Classification Search ..... 439/607, 439/541.5

See application file for complete search history.

(56) References Cited

U.S. PATENT DOCUMENTS 5,637,015 A 6/1997 Tan et al.
6,155,872 A 12/2000 Wu
6,162,089 A 12/2000 Costello et al.
6,238,244 B1 * 5/2001 Yang ..... 439/607
6,540,563 B1 * 4/2003 Hu et al. ..... 439/676
6,793,531 B1 9/2004 Zhang
6,976,870 B1 * 12/2005 Li ..... 439/541.5

* cited by examiner

*Primary Examiner*—Truc Nguyen
(74) *Attorney, Agent, or Firm*—Wei Te Chung

(57) ABSTRACT

This invention is related to an electrical connector assembly (10), the electrical connector assembly includes an insulative housing (1) defining a first aperture (112) and a second aperture (111) therein for receiving a complementary USB connector and a complementary RJ-45 connector respectively, a contact module (2) received in the insulative housing, an inner shield inserted in the first aperture along a mating direction of the mating of the complementary USB connector, and an outer shield (4) enclosing the insulative housing. The inner shield has two opposite plates and a plates-interconnecting section sandwiched between the outer shield and the insulative housing.

18 Claims, 6 Drawing Sheets

ELECTRICAL CONNECTOR ASSEMBLY HAVING AN IMPROVED INNER SHIELD

BACKGROUND OF THE INVENTION

1. Field of the Invention

The present invention relates to an electrical connector assembly, particularly to the electrical connector assembly having an improved inner shield.

2. Description of Related Art

To protect an electrical connector from outer electromagnetic interference, a conventional connector assembly for transmitting high speed signal usually includes an inner shield received in an receiving cavity and an outer shield enclosing the connector assembly, wherein the inner shield must be electrical connection with the outer shield. Such as U.S. Pat. No. 6,793,531 discloses an electrical connector having an inner shield received therein and an outer shield enveloping the connector, the inner shield has a pair of fingers formed at a rear end thereof and connected to a rear wall of the outer shield for grounding purpose and to protect the connector from the outer electromagnetic interference. However, the inner shield is secured to the housing only by a plurality of protrusions formed thereon. In this case, a movement of the inner shield along a mating direction is difficult to avoid during the mating of the complementary connector. As a result, the risk of that the figures cannot contact with the outer shield cannot avoid, and a good electrical connection between the inner shield and the outer shield cannot be achieved. Furthermore, the figure has a slantwise distal end extending rearwardly to a rear face of the insulative housing for contacting with the outer shield and forming an electrical connection therebetween, however, the slantwise distal end usually needs a complex processing of manufacture.

Hence, an improved electrical connector is desired to overcome the disadvantages and problems of the prior art.

SUMMARY OF THE INVENTION

Accordingly, it is an object of the present invention to provide an electrical connector assembly having an improved inner shield securely secured in the connector assembly for ensuring a steady electrical connection to an outer shield enclosing an insulative housing of the connector assembly.

Another object of the present invention is to provide an electrical connector assembly having an improved inner shield having a simple structure which has a simple processing for making.

In order to achieve the above mentioned objects, an electrical connector assembly comprises an insulative housing, a contact module, a generally U-shaped inner shield and an outer shield. The insulative housing defining a first aperture and a second aperture in a vertical arrangment for receiving a complementary USB connector and a complementary RJ-45 connector therein respectively. The contact module has a plurality of first contacts having contact sections exposed in the first aperture, and a plurality of second contacts having contact sections exposed in the second aperture. The inner shield is inserted into the first cavity of the insulative housing along a mating direction of the complementary USB connector, and has a pair of opposite plates substantially shielding the whole line of the contacts along a row's direction and a plates-interconnecting section attachable to the front face of the insulative housing. The outer shield has a front shielding member and a rear shielding member, the front shielding member has a front wall defining two openings align to the first aperture and the second aperture of the insulative housing, the front face can press the plates-interconnecting section to the front face of the insulative housing and protect the inner shield from moving along a horizontal direction during the mating process of the complementary USB connector. The plates-interrim section has two resilient figures having two opposite end pressed to outer shield for a stable electrical connection therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
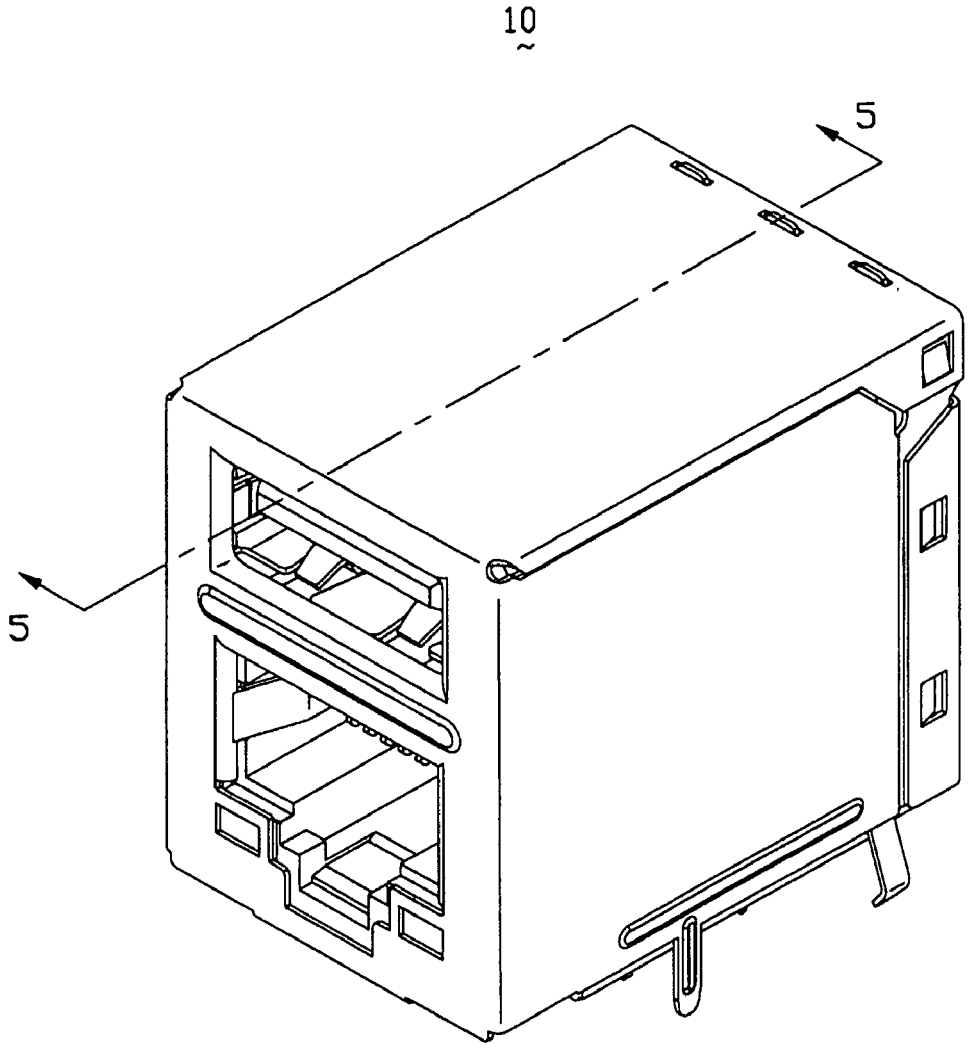
FIG. 1 is an assembled view of an electrical connector assembly according to the present invention.

Reference will now be made to the drawing figures to describe the present invention in detail.

Figure 2:
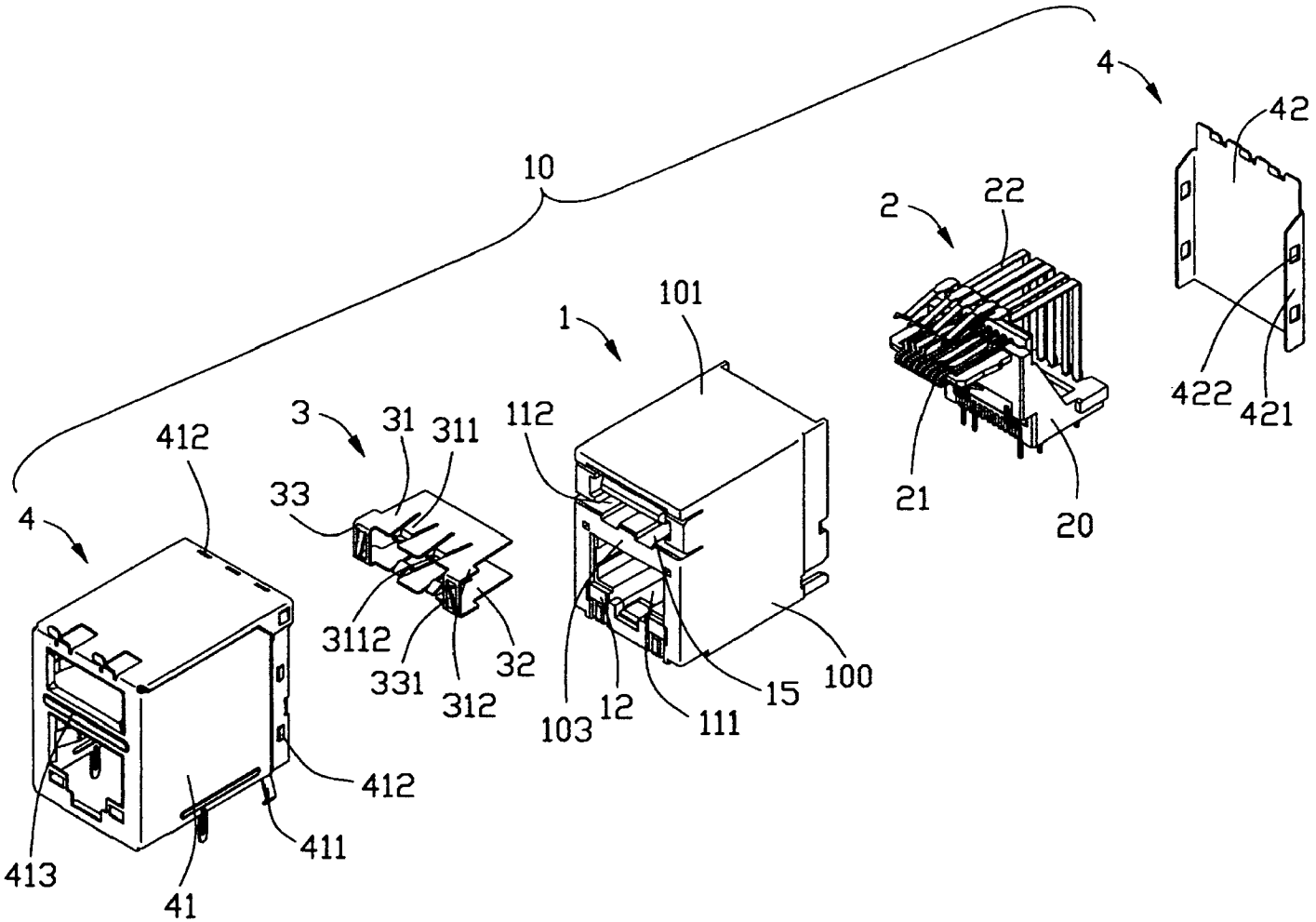
FIG. 2 is an exploded, perspective view of the electrical connector assembly in accordance with the present invention.

With reference to FIGS. 1–2, a connector assembly 100 in accordance with the present invention comprises an USB connector and an stacked RJ-45 connector. The connector assembly 100 is adapted to be mounted to a printed circuit board (PCB), and comprises a generally cubic insulative housing 1, a contact module 2 received in the insulative housing 1, an inner shield 3 and an outer shield 4 enclosing the insulative housing 1.

Figure 4:
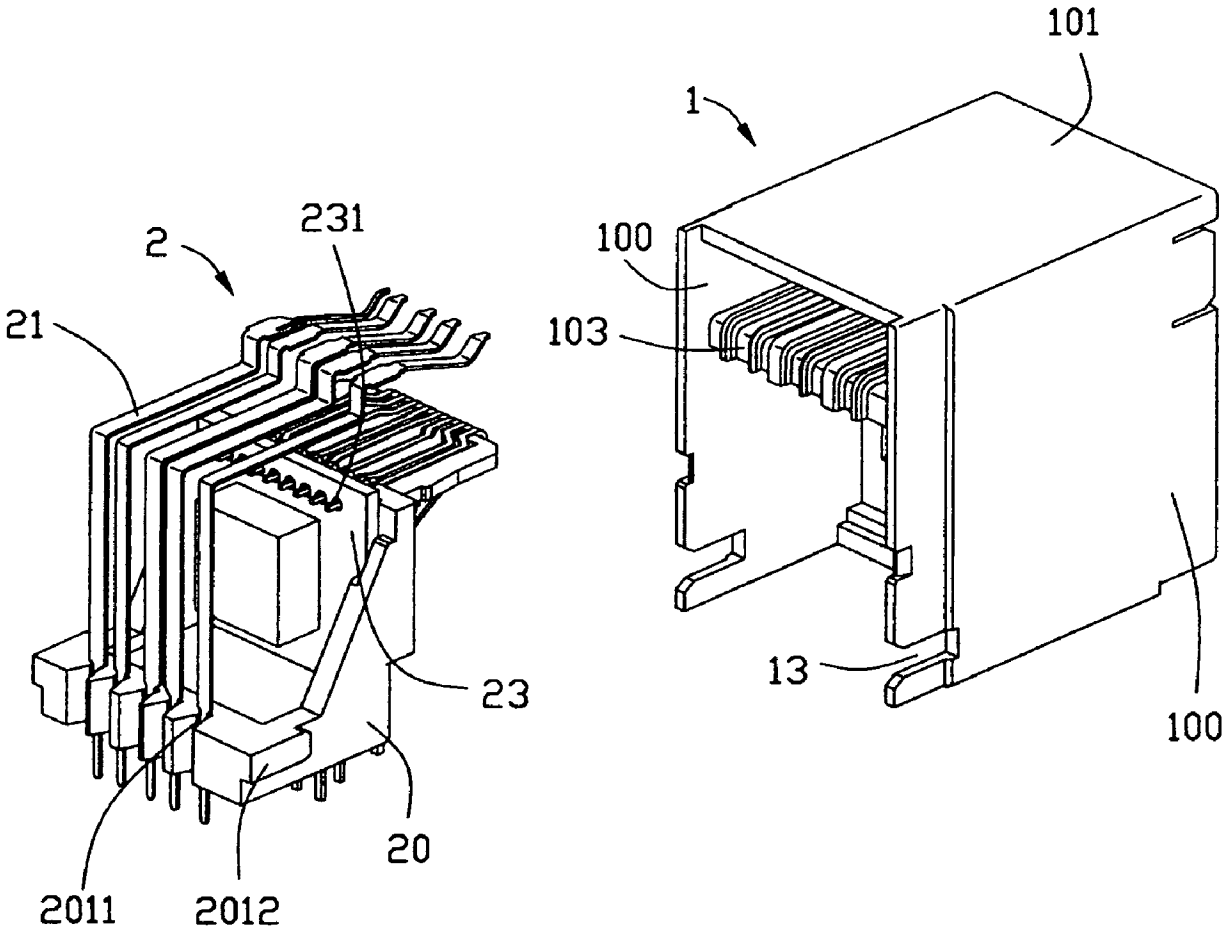
FIG. 4 is a perspective view of the contact module and a insulative housing shown in FIG. 2.
Figure 5:
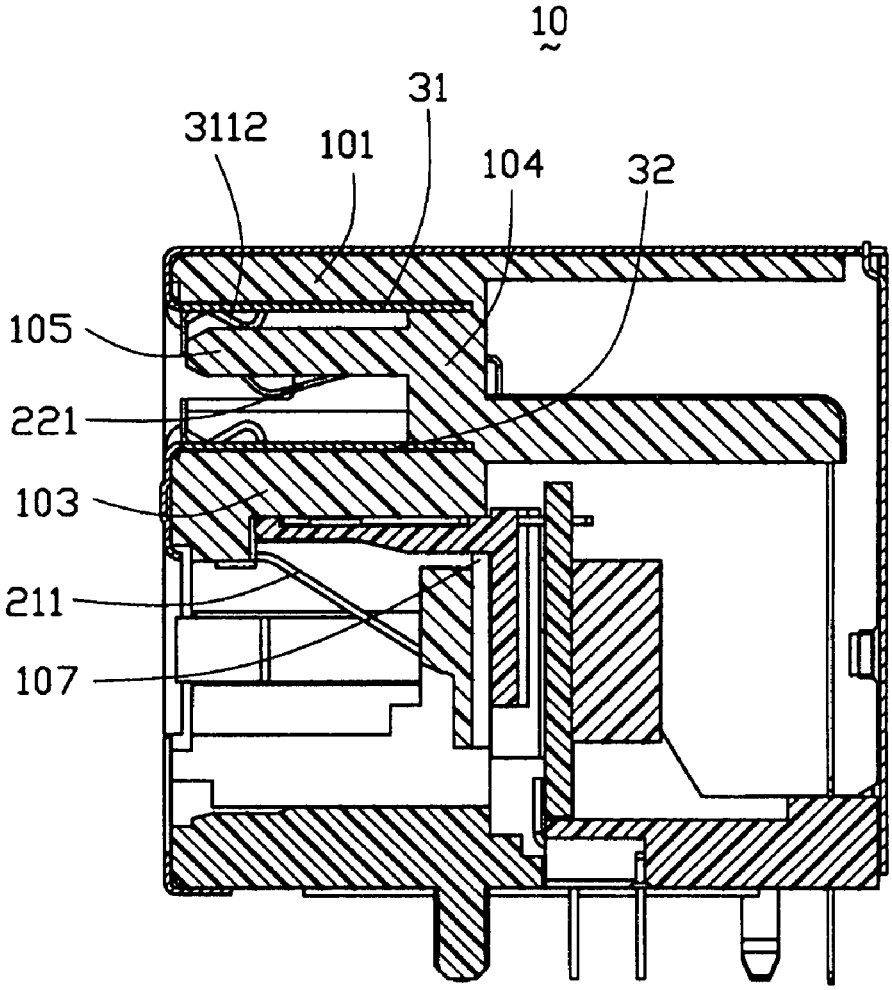
FIG. 5 is a cross-sectional view of the electrical connector assembly taken along lines 5—5 of FIG. 1.

Referring to FIG. 2, FIG. 4 and FIG. 5, the insulative housing 1 has a mating face 113 and a mounting face (not labeled) mountable to the PCB and defines a first aperture 112 and a second aperture 111 isolated from the first aperture 112 in the mating face 115 for receiving a complementary USB connector and a complementary RJ-45 connector respectively. A spacer 103 is formed between the first aperture 112 and the second aperture 111. A supporting plate 104 is perpendicular to the spacer 103 and received in a rear end of the first receiving space 112 for supporting a mating plate 105 extending perpendicularly therefrom. Two third receiving spaces (not labeled) are defined beside two sides of the second receiving space 111 for receiving a pair of light-emitting devices (LEDs) 12 thereinto to visually indicate full mating of the complementary RJ-45 connector.

Figure 3:
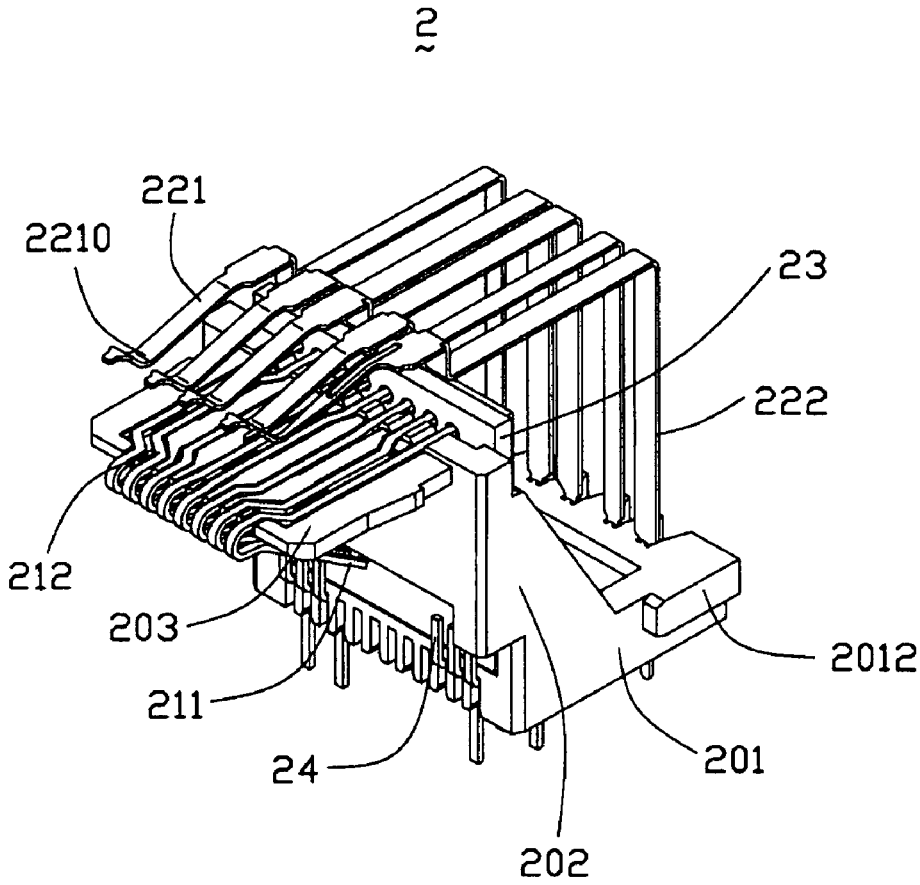
FIG. 3 is an amplified view of a contact module shown in FIG. 2.

Referring to FIGS. 2–4, the contact module 2 shown in FIG. 3 comprises an generally Z shaped insulative base 20, a plurality of first and second contacts 22, 21 received in the insulative base 20. The insulative base 20 has a bottom portion 201 defining a plurality of passageways 2011 therein for receiving an end of each first contacts 22 respectively and has a pair of protrusions 2012 in two sides thereof to secure the contact module 2 to the insulative housing 1, a vertical plate 202 extending upwardly from the bottom portion 201, and a tongue 203 extending perpendicularly from an end of the vertical plate 202. A plurality of transferring contacts 24 are received in a bottom face of the bottom portion 201, and have first contacting ends 241 connected to a circuit board 23 and a second contacting ends 242 mounted to the PCB for transferring the signal of the circuit board 23 to the PCB. Each second contact 21 has a contact section 211 hanging under the tongue 203 and a connecting section 212 received in the tongue 203. The circuit board 23 is attached to a back plane of the vertical plate 202 and defining a plurality of through holes 231 therein shown in FIG. 4 for receiving an end of the connecting section 212 of each second contact 21 and forming electrical connection therebetween. The signal of the second contacts is thereby transmitted to the PCB by the circuit board 23 and the transfer contacts 24. The first contacts 22 arranged in at least one row along a direction are right-angle shaped. Each first contact 22 includes a contact section 221 generally parallel to the tongue 203 and a vertical section 222 having an end through out the passageway 2011 of the bottom portion 201 and connected to the PCB directly. Each contact section 221 has a bending portion 2210 in a front end thereof for engagement with the mating contacts of the complementary USB connector.

Referring to FIGS. 2–5, to assemble the contact module 2 to the insulative housing 1, firstly, inserting the insulative base 20 having the second contacts 21 therein into the second aperture 111 from back to front. The protrusions 2012 of the bottom portion 201 then engage with a pair of slots 13 defined in a rear end of the insulative housing 1 respectively to secure the insulative base 20 in the second aperture 111. The tongue 203 received second contacts 21 therein is through out an opening 107 formed under the junction of the spacer 103 and the supporting plate 104, and abutting against a top wall of the second aperture 111. Wherein the contact sections 211 of the second contacts 21 are exposed in the second aperture 111 and engagable with corresponding mating contacts (not shown) of the complementary RJ-45 connector. Second, inserting the first contacts 22 into the first aperture 112 from back to front. Each contact section 221 of the first contact 22 is received in corresponding passageway (not labeled) defined in a bottom side of the mating plate 105. The bending portions 2210 are exposed in the first aperture 112 for mating with the complementary USB connector. The ends of the vertical sections 222 are finally pressed into the holes 2011 to secure the first contacts 22 in the base 20. Here, if the first aperture 112 further receives an inner shield, and the insulative housing 1 is further enclosed by an outer shield, an electrical connector assembly 100 according to the present invention will be formed. The more detail about the inner and outer shield will be described as following, and also about the assembly therebetween.

Figure 6:
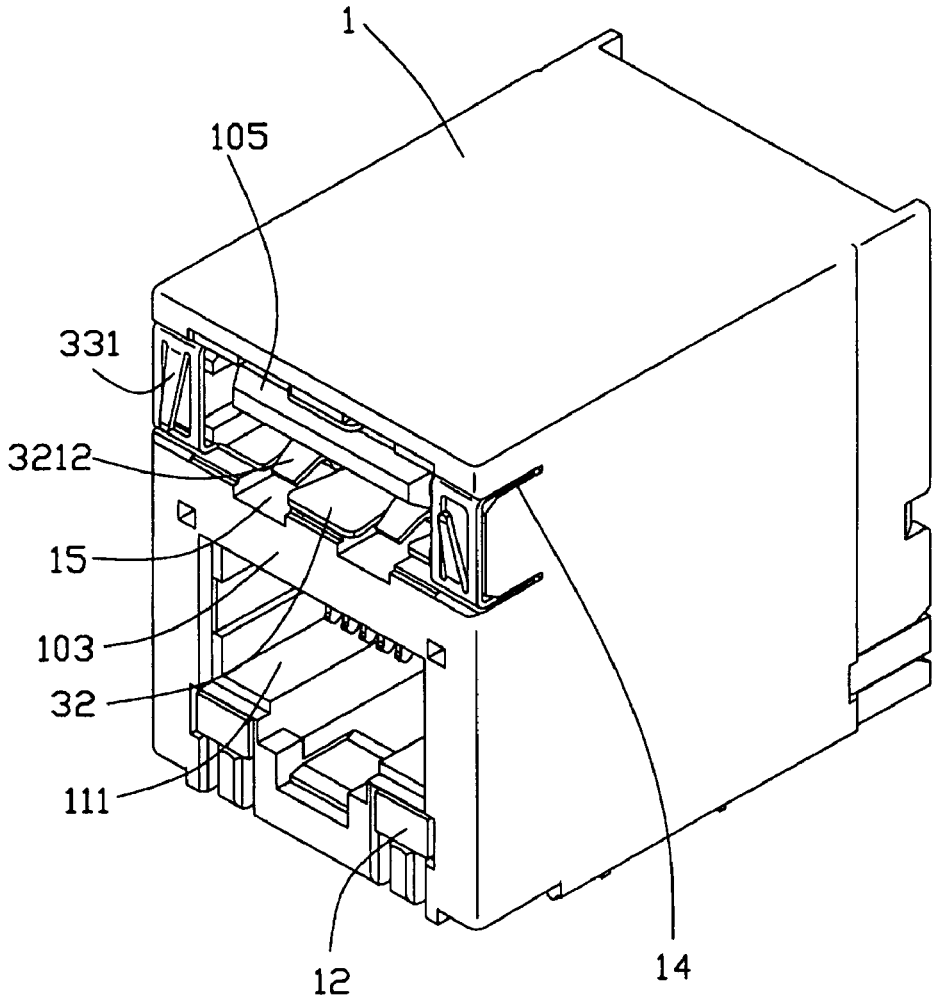
FIG. 6 is a perspective view of the electrical connector assembly shown in FIG. 1, and on which the outer shield is removed to show an engagement between the inner shield and the housing clearly.

Referring to FIG. 2 and FIG. 6, the inner shield 3 is generally U-shaped and made of metal materials. The inner shield 3 comprises an upper plate 31 and a lower plate 32 parallel to each other for substantially shielding the whole row of contact sections 221 of the first contacts 22 along the row's direction, and a plates-interconnecting section 33 attachable to the front face of the insulative housing 1. An inner opening (not labeled) formed in a front end of the inner shield 3 and communicated with the first aperture 112 is for engagement with the complementary USB connector. The plates-interconnecting section 33 has two punched resilient fingers 331 extending forwardly and beside two sides thereof for engagement with the outer shield 4, so as to form an electrical connection therebetween. The resilient fingers 331 have two opposite distal ends to balance an elastic force when the outer shield is pressed thereto. The upper plate 31 has two punched interval resilient pieces 311 engagable with corresponding recesses (not shown) defined in a top wall of the first receiving space 112, each resilient piece 311 forms a bending section 3112 in a end thereof and extending toward to the first aperture 112. The lower plate 32 has two similar resilient pieces regarding to the upper plate 31 for engagement with the recesses 15 defined in the upper surface of the spacer 103, and each similar resilient piece has a bending portion 3212 in an end thereof and extending upwardly. The upper plate 31 has two lateral edges 312 where the upper plate 31 is interconnected by the plate-interim section 33, the lower plate 32 has two similar lateral edges 312 to the upper plate 31. The edges 312 are for embedding into the insulative housing 1 and secure the inner shield 3 in the insulative housing 1.

The outer shield 4 enclosing the insulative housing 1 includes a front shielding member 41 and a rear shielding member 42, the front shielding member 41 includes a front wall 44, two sidewalls 45 and a top wall 46. A first opening 48, a second opening 47 and two third openings 50 are defined in the front wall 45 respectively corresponding to the first receiving space 112, the second receiving space 111 and the third receiving spaces of the housing 1. A middle plate 413 is formed between the first and second openings 48, 48 and corresponding to the spacer 103 of the insulative housing 1. Each sidewall 45 has a grounding leg 411 and a positioning post 49 extending from a bottom side thereof. The grounding leg 411 and the positioning post 49 are insertable to the PCB for grounding and positioning the outer shield 4. The rear shielding member 42 has two bending portions 421 extending perpendicularly from two side thereof, each bending portion 421 defines two latching holes 422 thereon. Each sidewall 45 further has two latching pieces 412 in a rear end thereof for engagement with corresponding latching holes 422 of the rear shielding member 42 and securing the rear shielding member 42 to the front shielding member 41.

After inserting the contact module 2 into the insulative housing 1, the inner shield 3 should firstly be inserted into the first aperture 112 along a mating direction of the complementary USB connector, wherein the lateral edges 312 of the upper and lower plate 31, 32 are received in corresponding slots 14 defined in the mating face of the insulative housing 1, and two free ends (not labeled) of the inner shield are received in the insulative housing 1. Simultaneous, the plates-interconnecting section 33 is abutting against a corresponding front end of each sidewall of the first aperture 112. The resilient pieces 311 of the upper plate 31 are received in the corresponding recesses defined in the top wall of the first aperture 112. Similarly, the resilient pieces of the lower plate 32 are received in recesses 15 defined in an upper surface of the spacer 103. After securing the inner shield 3 into the insulative housing 1, the front shielding member 41 is sequently mounted onto the insulative housing 1 from front to back, the rear shielding member 42 is then mounted on a rear surface of the housing 1 and secured to the front shielding member 41 by the engagement between the latching holes 422 and the latching pieces 412. Hereafter, the plates-interconnecting section 33 of the inner shield 3 is thereby sandwiched between the front wall 44 and the front face of insulative housing 1, as a result, the inner shield 3 will not moved to the outer shield 4 when the complementary USB connector is inserted into or drawn out from the first receiving space 112. Simultaneous, the resilient fingers 331 of the inner shield 3 are therefore pressed to the outer shield 4, so as to an excellent electrical connection therebetween can be attained. Thereby the inner shield 3 in accordance with the present invention is secured to the housing 1 steadily, and electrically connected with the outer shield 4 reliably, so that external electromagnetic interference can be fully avoided.

Although the present invention has been described with reference to the preferred embodiment, it is apparent to those skilled in the art that a variety of modifications and changes may be made without departing from the scope of present invention which is intended to be defined by the appended claims.

We claim:

1. An electrical connector comprising:

a insulative housing defining a mating aperture in a mating face thereof for receiving a complementary connector therein;

a plurality of contacts arranged in one row along a direction and each having a contact section exposed into the mating aperture;

an inner shield inserted into the mating cavity of the insulative housing along a mating direction of the complementary connector, the inner shield having a pair of opposite plates substantially shielding the whole row of the contacts, the inner shield formed with a plates-interconnecting section attached on the mating face of the insulative housing and defining an inner opening corresponding to the mating aperture; and an outer shield enclosing the insulative housing substantially, and defining a corresponding opening align to the mating aperture in a front wall thereof, the plates-interconnecting section sandwiched between the mating surface of the insulative housing and the front wall of the outer shield to establish a stable electrical connection with the outer shield;

wherein the plate of the inner shield has a free end buried in the insulative housing; and wherein the plate of the inner shield is formed with at least one reslient piece extending toward the mating aperture.

2. The electrical connector in accordance with claim 1, wherein the plates-interconnecting section is formed with a resilient figure abutting against the front wall of the outer shield.

3. The electrical connector in accordance with claim 1, wherein the plates-interconnecting section comprising a pair of plates-interconnecting subsection located at opposite sides of the inner opening, respectively.

4. The electrical connector in accordance with claim 1, wherein the insulative housing defining a pair of slits in the mating surface for receiving lateral edges, where the plates are interconnected by the plates-interconnecting section, of the inner shield.

5. The electrical connector in accordance with claim 1, further comprising second plurality of contacts having contact portions, and wherein the insulative housing defining a second mating aperture in the mating face thereof, and the contact portions are exposed in the mating cavity.

6. The electrical connector in accordance with claim 5, further comprising a contact module having a tongue extending forwardly into said second mating aperture, said second plurality of contacts are fixed to said contact module.

7. The electrical connector in accordance with claim 6, wherein the contact module comprises a circuit board vertically disposed therein and electrically connected to said second plurality of contacts, and a plurality of transfer terminals for electrically connecting said circuit board to a substrate.

8. A stacked electrical connector assembly comprising:

an insulative housing defining a first aperture and a second aperture in a vertical arrangement for receiving a complementary connector therein respectively, a mating face and a board-mounting face;

a contact module having a plurality of first contacts having contact sections exposed in the first aperture, and a plurality of second contacts having contact sections exposed in the second aperture;

a generally U-shaped inner shield inserted into the first aperture along a mating direction of the complementary connector and substantially shielding the contact sections of said first contact, the inner shield having a plates-interconnecting section attached to said front face of the insulative housing, and an inner opening communicated with the first aperture; and an outer shield around the insulative housing and having electrical connection with said plates-interconnecting section;

wherein the plate of the inner shield has a free end buried in the insulative housing; and wherein the plate of the inner shield is formed with at least one reslient piece extending toward the mating aperture.

9. The electrical connector assembly in accordance with claim 8, the outer shield has a front wall defining two opening respectively corresponding to the first aperture and the second aperture, and the plates-interconnecting section sandwiched between the front face of the insulative housing and the front wall of the outer shield.

10. The electrical connector assembly in accordance with claim 9, wherein the plates-interconnecting section has at least one resilient figure extending therefrom to contact with the outer shield.

11. The electrical connector assembly in accordance with claim 10 wherein the plates-interconnecting section comprising a pair of plates-interconnecting subsection located at opposite sides of the inner opening, respectively.

12. The electrical connector assembly in accordance with claim 11 wherein the resilient figure is formed at the plates-interconnecting subsection.

13. The electrical connector assembly in accordance with claim 12 wherein the insulative housing defining a pair of slits in the mating surface thereof for receiving lateral edges of the plates of the inner shield.

14. The electrical connector assembly in accordance with claim 13, wherein the plate has a free end embedded in the insulative housing.

15. The electrical connector assembly in accordance with claim 14, wherein the contact module has a bottom portion for receiving plurality of transfer contacts therein, a circuit board abutted to a vertical portion extending from the bottom portion, the second contacts have one ends received in the circuit board.

16. An electrical connector comprising:

a one piece insulative housing defining a receiving cavity recessed from a mating face thereof, a plurality of terminals disposed in the corresponding receiving cavity;

an inner metallic shell receiving in the receiving cavity and defining an U-shaped configuration with an upper plate and a lower plate connected by a bridge which has a central opening in alignment with said receiving cavity in mating direction; wherein the upper plated and the lower plate defines a plurality of first spring arms extending into the receiving cavity and deflectable in a vertical direction;

wherein the upper and lower plates of the inner shield has a free end buried in the insulative housing.

17. The electrical connector as claimed in claim 16, wherein the bridge defines a plurality of second spring arms extending forwardly and deflectable in the mating direction.

18. The electrical connector as claimed in claim 17, further including an outer metallic shell engagably covering said second spring arms in said mating direction.

* * * * *